US008436264B2

(12) United States Patent
Baek

(10) Patent No.: US 8,436,264 B2
(45) Date of Patent: May 7, 2013

(54) POWER TRANSMISSION MECHANISM FOR FOUR POLES CIRCUIT BREAKER

(75) Inventor: Ki Ho Baek, Chungcheongbuk-Do (KR)

(73) Assignee: LS Industrial Systems Co., Ltd., Anyang-Si, Gyeonggi-Do (KR)

( * ) Notice: Subject to any disclaimer, the term of this patent is extended or adjusted under 35 U.S.C. 154(b) by 366 days.

(21) Appl. No.: 12/984,572

(22) Filed: Jan. 4, 2011

(65) Prior Publication Data

US 2011/0168535 A1 Jul. 14, 2011

(30) Foreign Application Priority Data

Jan. 13, 2010 (KR) ..... 10-2010-0003248

(51) Int. Cl.
*H01H 9/26* (2006.01)
*H01H 33/12* (2006.01)
*H01H 73/00* (2006.01)

(52) U.S. Cl.
USPC ..... 200/50.32; 200/50.37; 200/50.39; 218/6; 218/8; 218/12

(58) Field of Classification Search ..... 200/50.32–50.4, 200/17 R, 18, 334, 330, 331, 337, 400, 401; 218/1–9, 12–22, 30–32, 44, 55, 58, 67–70, 218/78–80, 84, 119, 120, 140, 146, 152–154; 335/6–16, 167–174, 195–204
See application file for complete search history.

(56) References Cited

U.S. PATENT DOCUMENTS 4,251,700 A * 2/1981 Zaffrann et al. ..... 218/12
4,383,146 A * 5/1983 Bur ..... 200/17 R
4,574,170 A * 3/1986 Abe et al. ..... 200/401
4,882,557 A * 11/1989 Harper ..... 335/9
6,023,035 A * 2/2000 Azzola et al. ..... 218/7
6,747,532 B1 * 6/2004 Tobin et al. ..... 335/6
2004/0118668 A1 * 6/2004 Tobin et al. ..... 200/50.32

FOREIGN PATENT DOCUMENTS

| | | |
|---|---|---|
| EP | 0639845 | 2/1995 |
| GB | 2124032 | 2/1984 |
| JP | 50-104370 | 8/1975 |
| JP | 56-143632 | 11/1981 |
| JP | 61-74932 | 5/1986 |
| KR | 1992-0007029 | 9/1992 |
| KR | 1020090006680 | 1/2009 |
| WO | 2006/046869 | 5/2006 |

* cited by examiner

*Primary Examiner* — Michael Friedhofer

(74) *Attorney, Agent, or Firm* — Lee, Hong, Degerman, Kang & Waimey

(57) ABSTRACT

Provided herein is a power transmission mechanism of a four poles circuit breaker in which the contact points of a neutral pole thereof are brought into contact earlier at the time of closing and separated later at the time of opening than those of the other poles thereof, and according to the present invention, there is disclosed a power transmission mechanism of a four poles circuit breaker comprising: a switching shaft configured to provide a driving force for switching to the movable contactors of the poles; an arm provided to correspond to the four poles to transfer the rotational torque of the switching shaft; and a link configured to transfer the rotational torque of the arm to the movable contactor as a switching force, and provided to correspond to the four poles, wherein the sum of the length of the arm and the link in a neutral pole is longer than the sum of the length of the arm and the link in the poles excluding the neutral pole.

5 Claims, 2 Drawing Sheets

POWER TRANSMISSION MECHANISM FOR FOUR POLES CIRCUIT BREAKER

CROSS-REFERENCE TO A RELATED APPLICATION

Pursuant to 35 U.S.C. §119(a), this application claims the benefit of earlier filing date and right of priority to Korean Application No. 10-2010-0003248, filed on Jan. 13, 2010, the contents of which is incorporated by reference herein in its entirety.

BACKGROUND OF THE INVENTION

1. Field of the Invention

The present invention relates to a four poles circuit breaker, and more particularly, to a power transmission mechanism for the four poles circuit breaker.

2. Description of the Conventional Art

A four poles circuit breaker (namely, 3-phases 4-lines type circuit breaker) has a configuration comprising four movable contactors and stationary contactors corresponding to four poles, respectively, to switch 3-phase alternate current supply lines having R-pole (namely, R-phase), S-pole (namely, S-phase), and T-pole (namely, T-phase), and a neutral line having a neutral pole (N-pole or namely N-phase) grounded to the earth at the same time. Here, the neutral line is a line performing a very important role to safely supply electric power. It is because various relays for detecting an abnormal current caused by ground-fault current, short-circuit current, lightning, and the like, are connected and installed to a neutral line and a plurality of ground lines for stabilizing 3-phase voltage are also connected to the neutral line in order to prevent the damage of load devices from occurring or prevent a local electrical accident from being spread to a large range area.

Accordingly, in such a four poles circuit breaker, it is required to have a so called "fast closing and late opening" characteristic in which the movable contactor of a neutral pole is brought into contact with the corresponding stationary contactor earlier than the movable contactor of other poles in the meaning of first securing the ground when switching to a closing position, namely, to the ON position, and the movable contactor of a neutral pole is separated from the corresponding stationary contactor later than the movable contactor of other poles in the meaning of implementing circuit opening in a state that the ground is secured when switching to a trip position (opening position) of the circuit breaker.

For the fast closing and late opening characteristic, there has been proposed a configuration that the movable contactor of a neutral pole is disposed more close to the stationary contactor than the movable contactor of other poles (other three poles excluding the neutral pole) according to the related art. However, according to the related art, it may have a so called fast closing and late opening characteristic, but have a problem that electrical insulation of the neutral pole cannot be secured since the opening distance (namely, insulation distance) between the stationary contactor and the movable contactor in a neutral pole is shorter than the opening distance of other poles when opening the circuit.

SUMMARY OF THE INVENTION

Accordingly, the present disclosure is to solve the foregoing problem in the related art, and a first object of the present disclosure is to provide a power transmission mechanism for a four poles circuit breaker capable of implementing a fast closing and late opening characteristic of the neutral pole without disposing a movable contactor of the neutral pole close to the stationary contactor thereof than the movable contactor of other poles (three poles excluding the neutral pole). A second object of the present disclosure is to provide a power transmission mechanism of a four poles circuit breaker having a fast closing and late opening characteristic of the neutral pole in which an opening distance of the neutral pole is at least same as an opening distance of the other poles.

The first object of the present disclosure may be accomplished by providing a power transmission mechanism for a four poles circuit breaker according to the present invention, comprising: a switching shaft configured to provide a driving force for switching the movable contactors of four poles; an arm connected to the switching shaft to be rotated together therewith and provided to correspond to the four poles to transfer the rotational torque of the switching shaft; and links connected between the arm and the movable contactor to transfer the rotational torque of the arm to the movable contactor as a switching force, and provided to correspond to the four poles, wherein the sum of the length of the arm and the link in a neutral pole is longer than the sum of the length of the arm and the link in the poles excluding the neutral pole.

The second object of the present disclosure may be accomplished by providing a power transmission mechanism for a four poles circuit breaker according to the present invention, wherein at the time of opening operation of the circuit, the length ratio of the arm and the link in a neutral pole is determined to be different from the length ratio of the arm and the link in the phases excluding the neutral pole in such a manner that an opening distance between a contact of the movable contactor and a contact of the stationary contactor in a neutral pole is at least same as an opening between a contact of the movable contactor and a contact of the stationary contactor in the poles excluding the neutral pole.

BRIEF DESCRIPTION OF THE DRAWINGS

The accompanying drawings, which are comprised to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Figure 1:
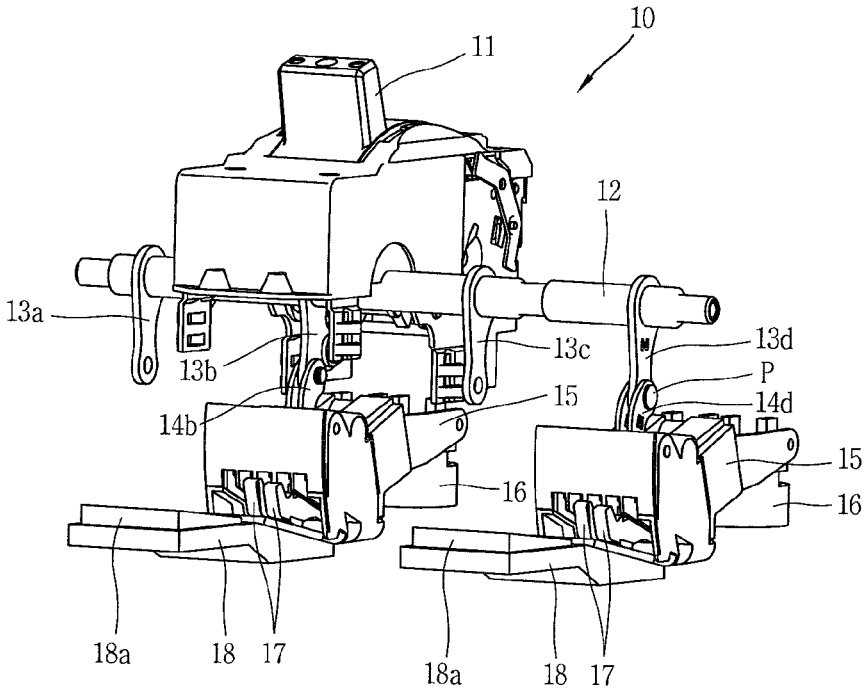
FIG. 1 is a perspective view illustrating the operation state and configuration for a power transmission mechanism for a four poles circuit breaker according to a preferred embodiment of the present invention when in a closing (ON) position.

The objective of the present invention, as well as the configuration and working effect thereof to accomplish the foregoing objective will be clearly understood by the following description for the preferred embodiments of present disclosure with reference to the accompanying drawings.

The configuration of a power transmission mechanism of a four poles circuit breaker according to a preferred embodiment of the present invention will be described with reference to FIGS. 1 through 4. FIGS. 1 through 4 are views merely illustrating movable contactors 17 and stationary contactors 18 provided to correspond to each of the four poles, a switching mechanism 10 for providing a switching force of the circuit breaker, and a power transmission mechanism of the four poles circuit breaker according to a preferred embodiment of the present invention for transferring the power of the switching mechanism 10 to the movable contactors 17 in a state that an external enclosure is removed in the four poles circuit breaker.

As illustrated in the drawing, a power transmission mechanism of a four poles circuit breaker according to a preferred embodiment of the present invention may comprise a switching shaft 12, arms 13*a*, 13*b*, 13*c*, 13*d*, and links 14*b*, 14*d*.

The switching shaft 12 provides a driving force for switching to the movable contactors 17 of four poles by rotation. Here, the rotation of the switching shaft 12 is provided by a driving force of the switching mechanism 10 which is well known and the detailed configuration of constituent elements thereof is omitted herein. As well known, the switching mechanism 10 may comprise a handle 11 illustrated herein, a lever for providing a rotation supporting point of the handle 11, a trip spring for providing a driving force that trips a circuit by charging elastic energy in the ON state and discharging the charged elastic energy when detecting an abnormal current such as a short-circuit current in the circuit, a latch for restraining or releasing the charged state of the trip spring, a holder 15 for supporting the movable contactor 17 to be rotated to a switching position of the circuit, an upper link connected to the latch, a lower link having an upper end portion connected to the upper link by a connecting pin and a lower end portion connected to the holder 15, and the like. The switching shaft 12 is commonly connected to the movable contactors 17 of four poles, to switch the movable contactors 17 of four poles i.e., the movable contactors 17 of four poles for alternate current 3 phases of R, S, T and a neutral pole (N-phase) at the same time.

The arms 13*a*, 13*b*, 13*c*, 13*d* are connected to the switching shaft 12 to be rotated together therewith, and provided to correspond to the four poles to transfer the rotational torque of the switching shaft 12 to the links 14*b*, 14*d*. The four arms 13*a*, 13*b*, 13*c*, 13*d* are coaxially provided at predetermined intervals to one another along the length direction of the switching shaft 12. According to a preferred embodiment of the present invention, the four arms 13*a*, 13*b*, 13*c*, 13*d* may be connected by welding to be rotated together. Since they are provided to correspond to four poles, in the four arms 13*a*, 13*b*, 13*c*, 13*d*, reference numeral 13*a* designates a R-phase arm, reference numeral 13*b* designates an S-phase arm, reference numeral 13*c* designates a T-phase arm, and reference numeral 13*d* designates an N-phase arm (neutral pole arm). According to a preferred embodiment of the present invention, it is configured such that the length of the N-phase arm (neutral pole arm) 13*d* is longer than the length of the arms of the poles (R, S, T poles) excluding the neutral pole, i.e., R-phase arm 13*a*, S-phase arm 13*b*, and T-phase arm 13*c*. By configuring such that the N-phase arm (neutral pole arm) 13*d* is longer than the length of the arms (13*a*, 13*b*, 13*c*) of the poles (R, S, T poles) excluding the neutral pole, it is shown a fast closing and late opening characteristic in which the movable contactor 17 of the neutral pole is brought into contact with the corresponding stationary contactor 18 earlier than the movable contactor of any other poles and the movable contactor 17 of the neutral pole is separated from the corresponding stationary contactor 18 later than the movable contactor of any other poles at the time of opening (tripping).

The links are provided to correspond to the poles of R, S, T, and N, and connected between the arms 13*a*, 13*b*, 13*c*, 13*d* and movable contactor 17 to transfer the rotational torque of the arms 13*a*, 13*b*, 13*c*, 13*d* to the movable contactor 17 as a switching force. The arms 13*a*, 13*b*, 13*c*, 13*d* corresponding to the links, as illustrated in FIG. 1, are connected to one another by a connecting pin (P) being connected through the arms 13*a*, 13*b*, 13*c*, 13*d* corresponding to the links. Due to a problem that they are hidden against one another, referring to FIGS. 1 and 3, the S-phase link 14*b* and N-phase link 14*d* are representatively shown only, but the configuration of the remaining R-phase link and T-phase link is same as described above, and thus the S-phase link 14*b* and N-phase link 14*d* may be referred to for the shape thereof. When the direction of a side of the stationary contactor 18 is forward in FIG. 2 while the shape of the arms 13*a*, 13*b*, 13*c*, 13*d* is a substantially straight type, the links have a forwardly convex arc shape. Accordingly, the links are rotated in a counter-clockwise direction when the arms 13*a*, 13*b*, 13*c*, 13*d* are rotated in a clockwise direction, and the links are rotated in a clockwise direction when the arms 13*a*, 13*b*, 13*c*, 13*d* are rotated in a counter-clockwise direction. At the time of opening operation of the circuit, the links, i.e., the links of four poles (phases) comprising the S-phase link 14*b* and N-phase link 14*d* have a predetermined length in such a manner that an opening distance between a contact of the movable contactor 17 and a contact of the stationary contactor 18 in a neutral pole is same as a distance (opening distance) between a contact of the movable contactor 17 and a contact of the stationary contactor 18 in the poles excluding the neutral pole. A lower end portion of the link may be directly connected to the movable contactor 17 or may be connected to a holder 16 supporting the movable contactor 17 to be rotated together therewith and thus indirectly connected to the movable contactor 17 through the holder 16.

On the other hand, for a fast closing and late opening operation characteristic of the neutral pole, the sum of the length of the arm 13*d* and the link 14*d* in the neutral pole is longer than the sum of the length of the arm 13*a*, 13*b*, 13*c* and the link (representatively, 14*b*) in the poles excluding the neutral pole. Since the sum of the length of the arm 13*d* and the link 14*d* in the neutral pole is longer than the sum of the length of the arm 13*a*, 13*b*, 13*c* and the link (representatively, 14*b*) in the poles excluding the neutral pole, in other words, since the moment arm is long, the arm 13*d* and the link 14*d* of the neutral pole are commonly rotated by an angle larger than the arm 13*a*, 13*b*, 13*c* and the link (representatively, 14*b*) in the poles excluding the neutral pole with respect to the same rotation angle of the switching shaft 12, and as a result, the movable contactor 17 of the neutral pole is brought into contact with the corresponding stationary contactor 18 earlier than the movable contactor 17 of the other poles (phases) at a trip position. The movable contactor 17 of the neutral pole is rotated by an angle larger than the movable contactor 17 of the other poles (phases) to be brought into contact with the corresponding stationary contactor 18, and thus, on the contrary, it is shown a fast closing and late opening operation characteristic during the tripping operation such that the movable contactor 17 of the neutral pole is separated from the corresponding stationary contactor 18 later than the movable contactor 17 of the other poles (phases).

According to a preferred feature of the present invention, the length ratio of the arm (N-phase arm) 13*d* and the link (N-phase link) 14*d* in a neutral pole is determined to be different from the length ratio of the arm 13*a*, 13*b*, 13*c* and the link (representatively, 14*b*) in the phases excluding the neutral pole in such a manner that an opening distance between a contact of the movable contactor 17 and a contact of the stationary contactor 18 in a neutral pole is at least same as a distance between a contact of the movable contactor 17 and a contact of the stationary contactor 18 in the poles excluding the neutral pole during the opening operation of the circuit, in other words, an insulation distance between the contact s is sufficiently secured during the opening operation of the circuit even for the neutral pole. According to a preferred embodiment of the present invention, when the lengths of the arm (N-phase arm) 13*d* and the link (N-phase link) 14*d* in a neutral pole may be 33.45 mm and 20.85 mm, respectively, the lengths of the arm 13*a*, 13*b*, 13*c* and the link (representatively, 14*b*) in the phases excluding the neutral pole may be 33 mm and 20.5 mm, respectively. When a simple comparison of the lengths is converted into a ratio of the lengths, the length ratio of the arm (N-phase arm) 13*d* and the link (N-phase link) 14*d* in a neutral pole is 1.604 to 1, the length ratio of the arm 13*a*, 13*b*, 13*c* and the link (representatively, 14*b*) in the phases excluding the neutral pole is 1.609 to 1. In other words, the length of the link (N-phase link) 14*d* in a neutral pole may is 1/1.604 compared to the length of the arm (N-phase arm) 13*d* and, whereas the length of the arm 13*a*, 13*b*, 13*c* in the phases excluding the neutral pole is 1/1.609 compared to and the link (representatively, 14*b*), and therefore, the length ratio of the arm (N-phase arm) 13*d* and the link (N-phase link) 14*d* in a neutral pole is larger than the length ratio of the arm 13*a*, 13*b*, 13*c* and the link (representatively, 14*b*) in the phases excluding the neutral pole. By configuring (determining) the length ratio of the arm (N-phase arm) 13*d* and the link (N-phase link) 14*d* in a neutral pole and the length ratio of the arm 13*a*, 13*b*, 13*c* and the link (representatively, 14*b*) in the phases excluding the neutral pole in such a manner according to a preferred embodiment of the present invention, the opening distance between the movable contactor 17 and the stationary contactor of four poles may have a sufficient insulation distance.

Referring to FIGS. 1 through 4, reference numeral 15 designates a holder for supporting the movable contactor 17 to be rotated together with the movable contactor 17 in the same direction by a driving force transferred from the link. Reference numeral 16 designates a rotation supporting base which is connected to an end portion of the holder 15 to provide a rotation supporting point of the holder 15. Reference numeral 18*a* designates a terminal portion exposed to an outer portion of the circuit breaker in the stationary contactor 18.

The operation of a power transmission mechanism for the four poles circuit breaker having the foregoing configuration according to a preferred embodiment of the present invention will be described with respect to FIGS. 1 through 4.

Figure 2:
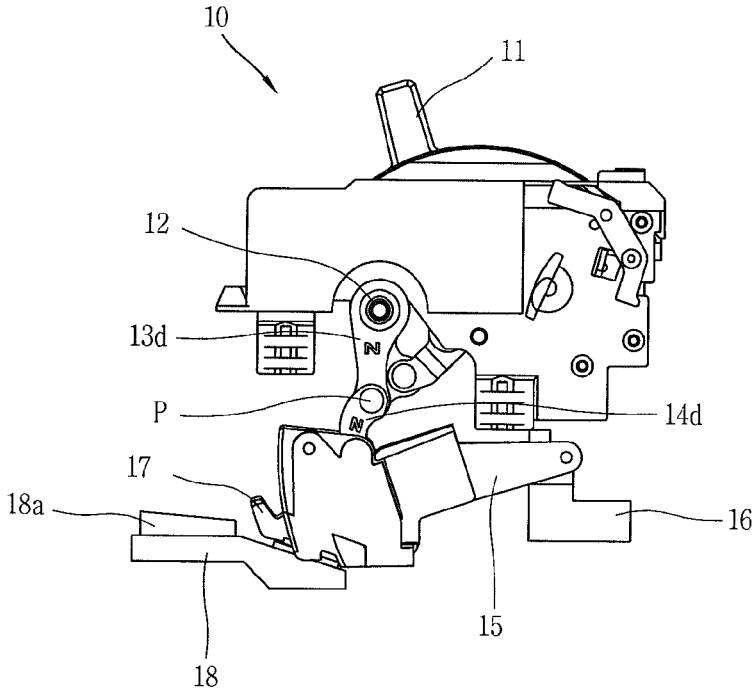
FIG. 2 is a side view illustrating the operation state and configuration for a power transmission mechanism for a four poles circuit breaker according to a preferred embodiment of the present invention when in a closing (ON) position.
Figure 3:
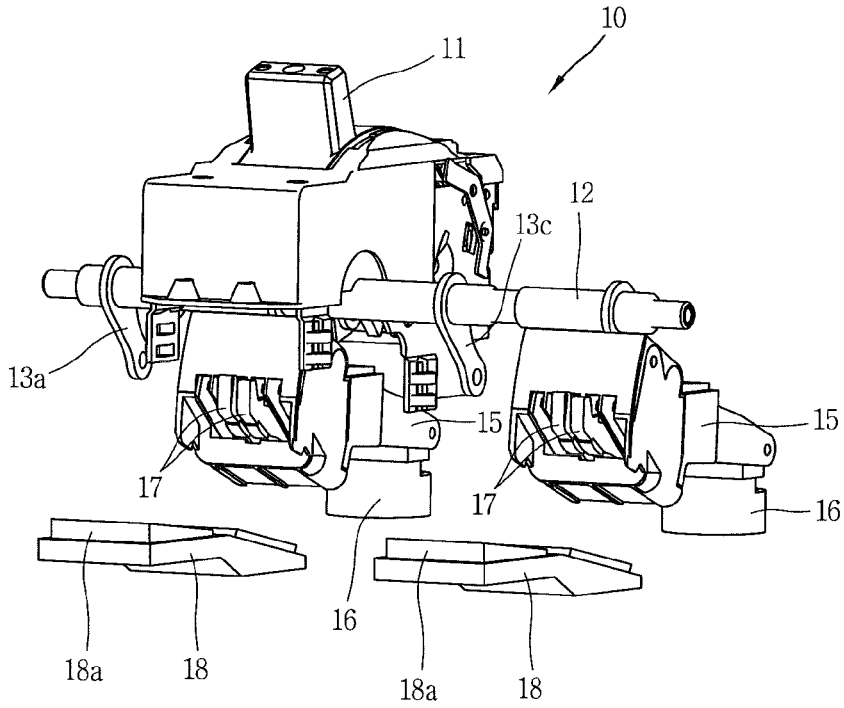
FIG. 3 is a perspective view illustrating the operation state and configuration for a power transmission mechanism for a four poles circuit breaker according to a preferred embodiment of the present invention when in a opening (OFF) position.
Figure 4:
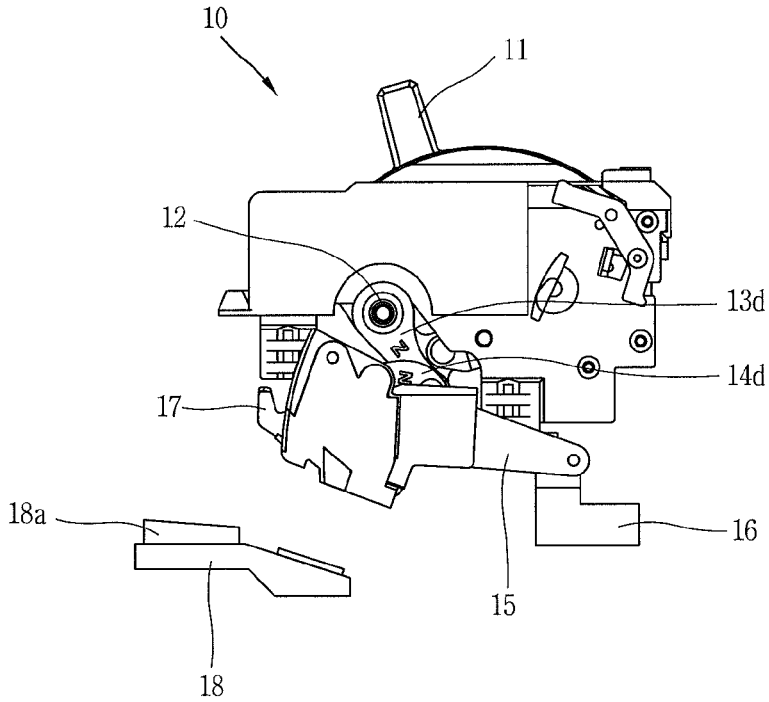
FIG. 4 is a side view illustrating the operation state and configuration for a power transmission mechanism of a four poles circuit breaker according to a preferred embodiment of the present invention when in a opening (OFF) position.

First, the operation from a closing (on) position of the four poles circuit breaker as illustrated in FIGS. 1 and 2 to a opening (off) position (namely, trip position) as illustrated in FIGS. 3 and 4 will be described.

The switching shaft 12 is rotated in a counter-clockwise direction by driving the switching mechanism 10, automatically by means of the trigger operation of the trip mechanism (not shown) according to the detection of an abnormal current in the circuit or manually by means of the off position manual user's operation of the handle 11. Then, the arms 13*a*, 13*b*, 13*c*, 13*d* connected to the switching shaft 12 to be rotated together therewith is rotated in a counter-clockwise direction, and thus the link (representatively, 14*b*, 14*d*) connected to the arms 13*a*, 13*b*, 13*c*, 13*d* by the connecting pin (P) is rotated in a clockwise direction. According to the clockwise rotation of the link (representatively, 14*b*, 14*d*), the movable contactor 17 directly connected to or indirectly connected to the link (representatively, 14*b*, 14*d*) through the holder 15 is also rotated in a clockwise direction, and thus, as illustrated in FIGS. 3 and 4, it is separated from the stationary contactor 18 and displaced to a position of opening the circuit. At this time, the movable contactor 17 of the neutral pole is rotated by an angle larger than the movable contactor 17 of the other poles (phases) to be brought into contact with the corresponding stationary contactor 18 (a state of being tripped), and thus, during the opening operation, on the contrary, it is shown a fast closing and late opening operation characteristic such that the movable contactor 17 of the neutral pole is separated from the corresponding stationary contactor 18 later than the movable contactor 17 of the other poles (phases). Furthermore, at this time, the opening distance between the movable contactor 17 and the stationary contactor of four poles may have a sufficient insulation distance by configuring (determining) the length ratio of the arm (N-phase arm) 13*d* and the link (N-phase link) 14*d* in a neutral pole and the length ratio of the arm 13*a*, 13*b*, 13*c* and the link (representatively, 14*b*) in the phases excluding the neutral pole.

Next, the operation from a opening (off) position (namely, trip position) of the four poles circuit breaker as illustrated in FIGS. 3 and 4 to a closing (on) position as illustrated in FIGS. 1 and 2 will be described.

The switching shaft 12 is rotated in a counter-clockwise direction by manually driving the switching mechanism 10 by means of the off position user's manual operation of the handle 11. Then, the arms 13*a*, 13*b*, 13*c*, 13*d* connected to the switching shaft 12 to be rotated together therewith is rotated in a clockwise direction, and thus the link (representatively, 14*b*, 14*d*) connected to the arms 13*a*, 13*b*, 13*c*, 13*d* by the connecting pin (P) is rotated in a counter-clockwise direction. According to the counter-clockwise rotation of the link (representatively, 14*b*, 14*d*), the movable contactor 17 directly connected to or indirectly connected to the link (representatively, 14*b*, 14*d*) through the holder 15 is also rotated in a counter-clockwise direction, and thus, as illustrated in FIGS. 1 and 2, it is brought into contact with the stationary contactor 18 to allow the circuit to be closed and displaced to a position capable of conduction. At this time, the movable contactor 17 of the neutral pole is rotated by an angle larger than the movable contactor 17 of the other poles (phases), and thus it is shown a fast closing and late opening operation characteristic such that the movable contactor 17 of the neutral pole is brought into contact with the corresponding stationary contactor 18 earlier than the movable contactor 17 of the other poles (phases).

A power transmission mechanism of a four poles circuit breaker according to the present disclosure may comprise a switching shaft configured to provide a driving force for switching to the movable contactors of four poles, an arm configured to transfer the rotational torque of the switching shaft, and a link configured to transfer the rotational torque of the arm to the movable contactor as a switching force, wherein the sum of the length of the arm and the link in a neutral pole is longer than the sum of the length of the arm and the link in the poles excluding the neutral pole, thereby providing an effect that the neutral pole may have a fast closing and late opening characteristic than any other poles (phases).

According to a power transmission mechanism of a four poles circuit breaker according to the present disclosure, the length of the arm in a neutral pole may be longer than the length of the arm in the poles excluding the neutral pole, thereby providing an effect that the neutral pole may have a fast closing and late opening characteristic than any other poles (phases).

According to a power transmission mechanism of a four poles circuit breaker according to the present disclosure, the length ratio of the arm and the link in a neutral pole may be different from the length ratio of the arm and the link in the phases excluding the neutral pole, and thus the rotation angle of the neutral pole holder may be same as or different from the rotation angle of the other pole (phase) holders. As a result, at the time of opening operation of the circuit, an opening distance between a contact of the movable contactor and a contact of the stationary contactor in a neutral pole is at least same as a distance between a contact of the movable contactor and a contact of the stationary contactor in the poles excluding the neutral pole, thereby providing an effect that an insulation distance of the neutral pole may be secured at least as much as any other poles at the time of opening operation of the circuit.

According to a power transmission mechanism of a four poles circuit breaker according to the present disclosure, the length ratio of the arm and the link in a neutral pole may be larger than the length ratio of the arm and the link in the phases excluding the neutral pole, and thus the rotation angle of the neutral pole holder may be same as or different from the rotation angle of the other pole (phase) holders. As a result, at the time of opening operation of the circuit, an opening distance between a contact of the movable contactor and a contact of the stationary contactor in a neutral pole is at least same as a distance between a contact of the movable contactor and a contact of the stationary contactor in the poles excluding the neutral pole, thereby providing an effect that an insulation distance of the neutral pole may be secured at least as much as any other poles at the time of opening operation of the circuit.

What is claimed is:

1. A power transmission mechanism for a four poles circuit breaker, the mechanism comprising:

a switching shaft configured to provide a driving force for switching the movable contactors of four poles;

an arm connected to the switching shaft to be rotated together therewith and provided to correspond to the four poles to transfer the rotational torque of the switching shaft; and links connected between the arm and the movable contactor to transfer the rotational torque of the arm to the movable contactor as a switching force, and provided to correspond to the four poles, wherein the sum of the length of the arm and the link in a neutral pole is longer than the sum of the length of the arm and the link in the poles excluding the neutral pole.

2. The mechanism of claim 1, wherein the length of the arm in a neutral pole is longer than the length of the arm in the poles excluding the neutral pole.

3. The mechanism of claim 1, wherein at the time of opening operation of the circuit, the length ratio of the arm and the link in a neutral pole is determined to be different from the length ratio of the arm and the link in the phases excluding the neutral pole in such a manner that an opening distance between a contact of the movable contactor and a contact of the stationary contactor in a neutral pole is at least same as a distance between a contact of the movable contactor and a contact of the stationary contactor in the poles excluding the neutral pole.

4. The mechanism of claim 3, wherein the length ratio of the arm and the link in a neutral pole is larger than the length ratio of the arm and the link in the phases excluding the neutral pole.

5. The mechanism of claim 1, wherein at the time of opening operation of the circuit, the link has a predetermined length in such a manner that an opening distance between a contact of the movable contactor and a contact of the stationary contactor in a neutral pole is same as a distance between a contact of the movable contactor and a contact of the stationary contactor in the poles excluding the neutral pole.

* * * * *